United States Patent [19]

Suzaki et al.

[11] 4,301,754

[45] Nov. 24, 1981

[54] ELECTRIC SEWING MACHINE

[75] Inventors: Kazuo Suzaki, Oohasuhigashi; Hirokazu Koda, Nara; Kenichi Nakamura, Nara; Syuich Yoshikawa, Nara; Naoki Ohara, Toyota, all of Japan

[73] Assignees: Sharp Kabushiki Kaisha; Aishin Seiki Kabushiki Kaisha, both of Osaka, Japan

[21] Appl. No.: 44,759

[22] Filed: Jun. 1, 1979

[30] Foreign Application Priority Data

Jun. 3, 1978 [JP] Japan ..... 53-67070

[51] Int. Cl.[3] ..... D05B 3/02

[52] U.S. Cl. ..... 112/158 E; 112/158 A

[58] Field of Search ..... 112/158 E, 158 A, 158 D, 112/158 R, 158 C

[56] References Cited

U.S. PATENT DOCUMENTS 3,699,910 10/1972 Urciola et al. ..... 112/158 A
4,066,029 1/1978 Suchsland et al. ..... 112/158 E
4,134,351 1/1979 Giesselmann ..... 112/158 A
4,186,675 2/1980 Yamashita et al. ..... 112/158 E X

FOREIGN PATENT DOCUMENTS 2731022 1/1978 Fed. Rep. of Germany ... 112/158 E
2735428 2/1978 Fed. Rep. of Germany ... 112/158 E

*Primary Examiner*—Peter P. Nerbun
*Attorney, Agent, or Firm*—Birch, Stewart, Kolasch and Birch

[57] ABSTRACT

This invention is directed to an electric zig zag sewing machine comprising a plurality of stacked pattern cams mounted on a rotation axis, each of the cams bearing different information of corresponding pattern of stitches, a cam follower mounted on a rod for movement in the direction parallel to said axis, a plurality of select switches for selecting any one of the pattern cams and electric control circuit arrangement for moving the cam follower to a position corresponding to any one of the cams selected by one of the select switches.

6 Claims, 7 Drawing Figures

ELECTRIC SEWING MACHINE

FIELD OF THE INVENTION

The present invention relates to an electric sewing machine, particularly to an electric sewing machine provided with a mechanism for selecting one of the plurality of pattern cams automatically by operation of one of the select switches for placing stitches on a cloth with a required pattern.

BACKGROUND OF THE INVENTION

In a sewing machine referred to as zig zag sewing machine for making one or more required stitching patterns on a cloth, at least one cam follower is provided for following the peripheral surface of a pattern cam so as to oscillate the stitching needle corresponding to the shape of the pattern cam. Such sewing machine is also provided with a pattern selecting mechanism for selecting a required pattern cam from various pattern cams.

In one conventional pattern selecting mechanism, a cam follower is adapted to be moved to a position of the required pattern cam by manual rotating operation of a dial. The conventional cam selecting mechanism of the type has disadvantages in that an operator of the sewing machine must operate the dial by applying a strong turning force. In addition, it takes long time to complete the cam selecting operation of the required cam.

For eliminating those deflects, U.S. Pat. No. 3,874,312 discloses electric cam selector mechanism having a plurality of cam selector units each of which comprises a solenoid and an arm member being rotated by said solenoid to contact a corresponding pattern cam. This cam selector mechanism has disadvantages in that a number of solenoids must be provided, which requires large space relative to a limited space of a sewing machine and also the cam selector mechanism becomes much more complicated as the number of pattern cams is increased.

SUMMARY OF THE INVENTION

The present invention is made to eliminate the disadvantages inherent in a conventional cam selector mechanism for sewing machines, and therefore, it is an essential object of the present invention to provide an electric sewing machine having an electric cam selector which is simple in construction and compact in size.

Another object of the present invention is to provide an electric sewing machine being capable of stitching various kinds of patterns on a cloth by a simple operation.

A further object of the present invention is to provide a sewing machine having a cam selector mechanism capable of automatically selecting a predetermined pattern when an electric power is switched on.

The other objects and the feature of an electric sewing machine according to the present invention will be apparent from the explanation made hereinafter in conjunction with preferred embodiment of the present invention with reference to the attached drawings.

DETAILED DESCRIPTION OF THE PREFERRED EMBODIMENT

Figure 1:
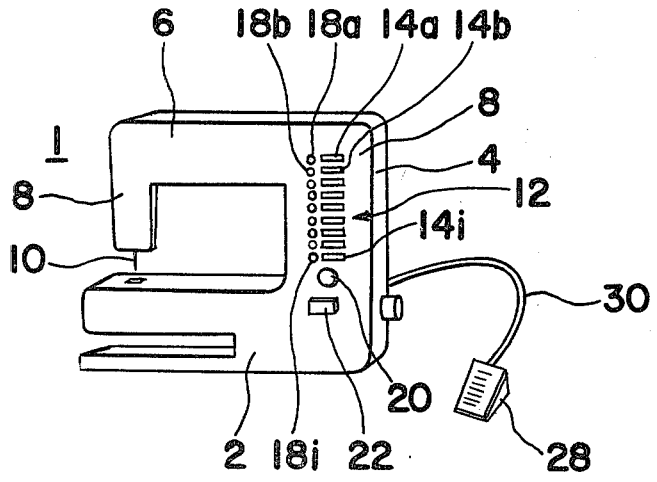
FIG. 1 is an outside view showing an embodiment of the electric sewing machine according to the present invention.

Referring to FIG. 1, a sewing machine 1 includes a bed 2 from which rises a standard 4 supporting a bracket arm 6 overhanging the bed 2. The arm 6 supports a head 8 which has a needle 10 projecting outwardly and downwardly towards the bed 2. Disposed on the front surface of the standard 4 is control panel 12, including a plurality of, for example, nine, buttons **14*a* to 14*i*, eight indication lamps 18*b* to 18*i* for the select buttons 14*b* to 14*i*, respectively, a sewing pitch control dial 20 and a button 22 for effecting a retreat movement of the cloth. The sewing pitch control dial 20 has an index arrow 20*a* which is, as the dial 20 is rotated, selectively brought in register with character S (not shown) and numerical markings scaled adjacent to and around the dial 20. When the arrow 20*a* points "0", the cloth under the needle 10 is held at a standstill so that the needle 10 can carry out the sewing repeatedly on the same place of the cloth. Upon rotation of the dial 20 to bring the index arrow 20*a* in register with one of the numerical markings, the cloth is advanced in a predetermined sewing pitch determined by the position of the dial 20 so rotated. The sewing pitch is greater as the weight of the numerical markings increases larger. When the dial 20** is rotated to a position S, the sewing pitch is controlled to cause the cloth to advance at a varying pitch.

Figure 2:
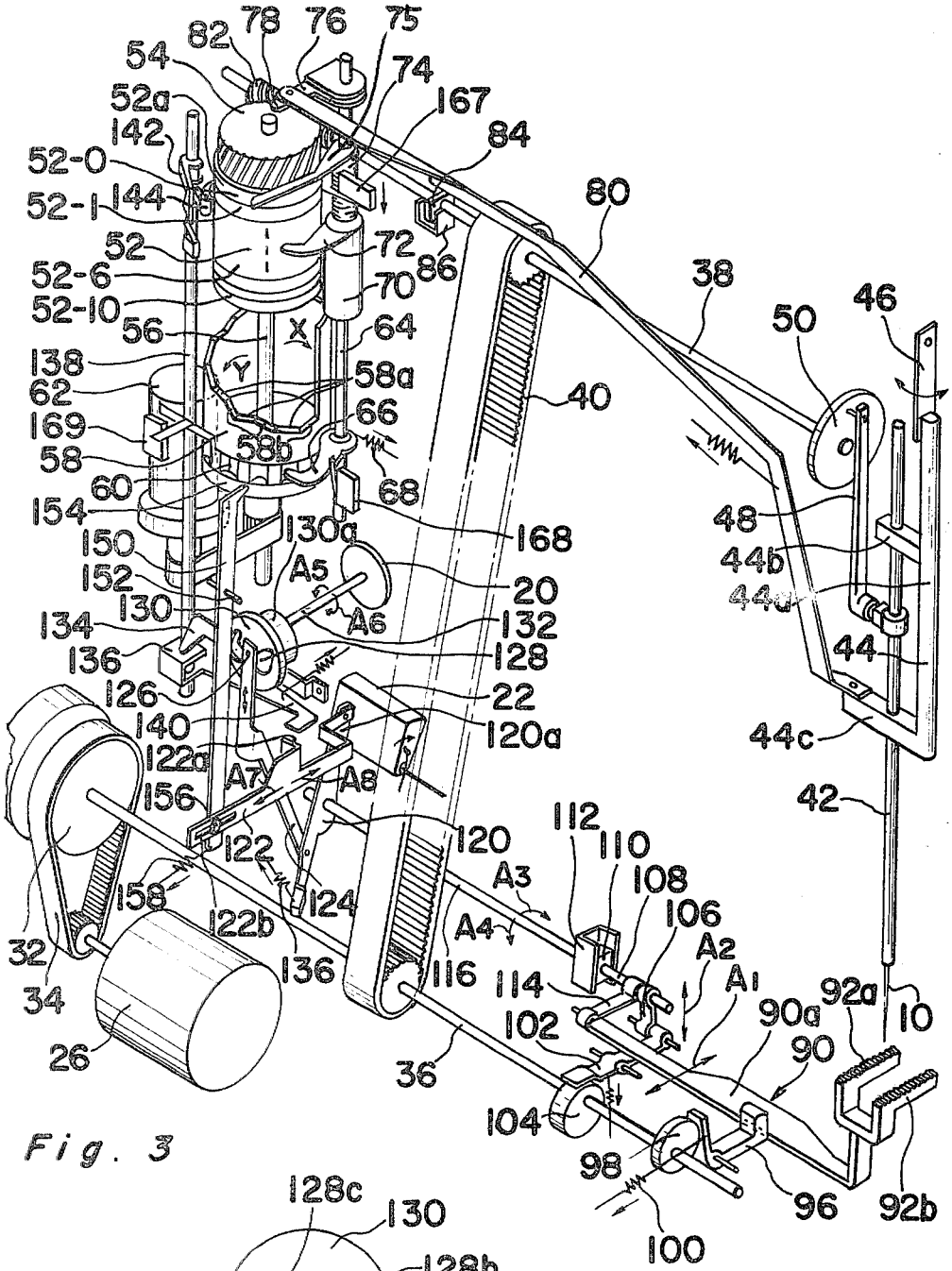
FIG. 2 is a perspective view showing an essential parts of a mechanism of embodiment of the electric sewing machine according to the present invention.

Referring to FIG. 2, there is shown a mechanism of the sewing machine 1. The mechanism can be briefly divided into first and second sections, the first section being a needle actuating mechanism while the second section is cloth moving mechanism. Each of such mechanisms is actuated by a motor 26 which is controlled by a foot-switch 28 connected to the machine 1 through a cable 30, as shown in FIG. 1. The rotation of the motor 26 is transmitted to a fly-wheel 32 through an endless belt 34. The fly-wheel 32 is rigidly mounted on a shaft 36 which is in common with a main shaft for the cloth moving mechanism. The shaft 36 is connected to another shaft 38 for the needle actuating mechanism through an endless belt 40 so that the shaft 36 and 38 can be rotated simultaneously with each other during rotation of the motor 26. Each mechanism is described in detail hereinbelow.

Needle actuating mechanism

The thread carrying needle 10 is affixed to a needle bar 42 which is slidably supported by an F-shaped framework 44 having an up-right bar 44*a* and two parallel bars 44*b* and 44*c* extending laterally from the bar 44*a*. The needle bar 42 is slidably inserted through holes formed in the bars 44*b* and 44*c*. A rectangular spring plate 46 has one end connected to the upper end of the up-right bar 44*a* and the other end connected to the frame of the sewing machine, whereby the F-shaped framework can undergo a swinging motion. At an intermediate portion between the bars 44*b* and 44*c*, the needle bar 42 is tightly held by a link 48 which is connected to a crank 50 mounted on the shaft 38. Therefore, the rotation of the shaft 38 is converted into the reciprocal movement of the needle bar 42 by the crank 50. The lateral jogging movement of the needle 10 can be obtained by the swing motion of the F-shaped framework 44. This swing motion is controlled by a cam mechanism.

The cam mechanism includes a plurality of cams 52, for example eleven cams 52-0, 52-1, . . . 52-10 placed one above the other and rigidly connected to each other. Each of the cams 52 has high cam lobes and low cam stations on the peripheral portion of the cam in correspondence with stitching patterns to be formed on a cloth. In this embodiment, the lowermost cam 52-10 is for straight stitching. Such cam arrangement 52 is also rigidly connected to a spur gear 54 and is rotatably mounted on a shaft 56 so that the gear 54 rotates together with the cam arrangement freely about the shaft 56. A rod 64 having a rectangulay cross section is provided adjacent the cam arrangement 52 with it opposite ends rotatably journalled to the frame of the sewing machine. Mounted on the rod 64 is a cylindrical arm carrier 70 which slidably displaces along the rod 64. A step-formed drum 58 is rigidly mounted on the shaft 56 while a timing cam 60 is also rigidly mounted on the shaft 56. Since an upper annular end of the drum 58 is formed with a generally helical cam face composed of a plurality of steps 58*a* and a corresponding number of slopes 58*b* each positioned between every adjacent two of the steps 58*a*, the arm carrier 70 having its lower end resting on the upper annular end face of the drum descends or elevates along the rod 64 as the drum 58 is rotated in a direction as shown by the arrow X or in a direction as shown by the arrow Y, respectively, about the shaft 56 by a motor 62 connected to the shaft 56. The step-formed drum 58 is provided for supporting the cylindrical arm carrier 70 at a desired level. The position of the drum 58 shown in FIG. 2 supports the carrier 70 at the highest level. Upon rotation of the drum 58 in the direction X by the actuation of the motor 62, the carrier 70 is gradually lowered.

An arm 66 is mounted on the rod 64 at a position adjacent the timing cam 60 by means of a clicking clutch means (not shown), said clicking clutch means being so designed as to enable the arm 66 to rotate clockwise about and independently of the rod 64 and also to rotate counterclockwise together with the rod 64. A free end of the arm 66 remote from the rod 64 is engaged to the timing cam 60. A spring 68 is connected to the arm 66 to bias the arm 66 and the rod 64 to rotate in a clockwise direction when viewed form top. The cylindrical shaped arm carrier 70 is slidably mounted on the rod 64 and carries cam follower 72 also mounted on the rod 64. A coil spring 74 mounted on the rod 64 biases the cam follower 72 and the cam carrier 70 downwardly with a bottom end of the arm carrier 70 held in contact with a stepped upper edge of the drum 58. Since the upper edge of the drum 58 is provided with steps, the rotation of the drum 58 moves the carrier 70 along the rod 64 to vary the level of the carrier 70. When the carrier 70 is slid along a slope defined between every two neighboring steps in the drum 58 for changing the level thereof, the arm 66 slides over a corresponding projecting portion of the timing cam 60 while the arm 66 is pivoted accompanied by a rotation of the shaft 64 in a counterclockwise direction. Therefore, during the displacement of the cam follower 72 up and down, the cam follower 72 is disengaged from the cam 52. On the other hand, when the carrier 70 is in contact with a flat edge of the drum 58, the arm 66 is positioned in a recess defined between the two neighboring projections of the timing cam 60 and, hence, the cam follower 72 is held in contact with one of the cams 52-0, 52-1 . . . 52-10 in the cam arrangement 52. Rigidly mounted at upper portion of the shaft 64 is a disc plate 76 having a projection 78. This projection 78 is pivotally connected to a bar member 80 which extends to the bar 44*c* of the F-shaped framework 44.

A worm gear 82 is mounted on the shaft 38 and engaged to the spur gear 54. Also mounted on the shaft 38 is a magnet 84 which rotates together with the shaft 38. During the rotation of the shaft 38, the magnet 84 moves past a magnetic flux detecting means 86 for producing one pulse per complete rotation of the shaft 38, that is, upon sewing of one stitch. It is to be noted that the magent 84 is so mounted and so positioned on the shaft 38 that the detecting means 86 can produce the pulse at the moment when the needle 10 reaches the most raised point.

The operation of the needle actuating mechanism is described hereinbelow.

Upon one rotation of the shaft 38, the needle 10 undergoes one reciprocation. Also the rotation of the shaft 38 causes the rotation of the cam arrangement 52 through the engagement between the worm gear 82 and the spur gear 54. The rotation of the cam arrangement 52 causes a jogging movement of the cam follower 72 by following high cam lobes or low cam stations and, thus, the projection 78 is jogged accordingly. This jogging movement is transmitted to the F-shaped framework 44 through the bar member 80 to swing the needle 10 laterally. Thus, the zig-zag sewing can be effected according to a pattern determined by the selected cam in the cam arrangement 52 to which the arm 72 is the engaged. When it is necessary to change the cam, that is, to change the level of the arm 72, the motor 62 is turned on by a suitable switch means such as the one electrically coupled to the buttons 14*a* to 14*i* in a manner as will be described in detail later with reference to FIG. 4. When the motor 62 is so turned on the shaft 56 is rotated to rotate the drum 58 and the timing cam 60. The rotation of the timing cam 60 causes the arm 66 to jog accordingly while the rotation of the drum 58 moves the cam follower 72 up or down together with the carrier 70 along the shaft 64. Since the vertical displacement of the cam follower 72 is carried out during the movement of the arm 66 over the projecting portion of the timing cam 60, the cam follower 72 is held clear of the cam arrangement 52.

A microswitch 167 is placed near the top portion of the cams 52 to detect the cam follower 72 when it reaches the first cam 52-0.

Another microswitch 169 is placed near the bottom portion of the drum 58 to detect the arm carrier 72 when it reaches the lowermost position i.e., the cam follower 72 reaches the lowermost cam or the eleventh cam 52-10.

A further microswitch 168 is placed adjacent to the arm 66 which actuate the lever of the microswitch 168 when the arm 66 follows the projection of the timing cam 60.

Cloth moving mechanism

A rack member 90 having a pair of saw tooth edges 92*a* and 92*b* and an elongated bar portion 90*a* is movably accommodated in the bed 2 of the sewing machine 1. An L-shaped block 96 journalled to the frame of the sewing machine has one end portion held in contact with one side edge of the bar portion 90*a* while the other end portion thereof is held in contact with a disc 98 which is eccentrically rigidly mounted on the shaft 36. The L-shaped block 96 is normally biased in one direction by a spring 100 with said other end portion thereof held in contact with the disc 98. Upon rotation of the shaft 36, the L-shaped block 96 is rocked to provide a lateral movement force to the rack member 90 in a direction as indicated by the arrow A1 in FIG. 2.

An elongated seesaw plate 102 pivotally supported at its substantially intermediate portion by a pin is provided adjacent the L-shaped block 96. This plate 102 has one end overlaying and engaged to a peripheral face of a disc 104 which is eccentrically rigidly mounted on the shaft 36. The other end portion of the plate 102 is hingedly connected to one end of an arm 106. The other end of the arm 106 is also hinged to a bar 108 which extends from a cubic block 110 slidably accommodated in a casing 112 of a substantially U-shaped cross section. The end of the bar portion 90*a* of the rack member 90 remote from the tooth edges 92*a* and 92*b* is hinged to one end of an arm 114 while the other end of the arm 114 is also hinged to the bar 108. In this construction, during the rotation of the shaft 36, the plate 102 undergoes a seesaw motion to move the bar 108 vertically in a direction as indicated by the arrow A2 in FIG. 2.

When the groove in the casing 112 is vertically oriented such as shown in FIG. 2, the bar 108 vertically moves as the cubic block 110 reciprocates in the groove of the casing 112. In this case, the rack member 90 is moved only in a vertical direction A2. Therefore, the cloth positioned above the saw tooth edges is held standstill. When the groove in the casing 112 is slanted in one direction as a result of rotation of a shaft 116 connected to the casing 112 in a direction as indicated by an arrow A3, the cubic block 110 reciprocates accordingly along the groove in the casing 112. In this case, the rack member 90 undergoes such a motion that an end portion of the bar portion 90*a* of the rack member 90 adjacent the toothed edges 92*a* and 92*b* describes an oval orbit in a counterclockwise direction, when viewed from the right-hand end, whereby the cloth is advanced. The pitch of advance is controlled by the setting of the sewing pitch control dial 20 which determines the angle through which the casing 112 reciprocately rotates together with the shaft 116.

On the other hand, when the groove in the casing 112 is slanted in the other direction as a result of rotation of the shaft 116 in a direction as indicated by the arrow A4, the cubic block 110 reciprocates accordingly along the groove for causing the rack member 90 to move following a similar oval orbit in a clockwose direction when view from the right-hand end. In this case, the cloth is retreated. The manner in which the rotation of the shaft 116 is controlled is described hereinbelow.

Figure 3:
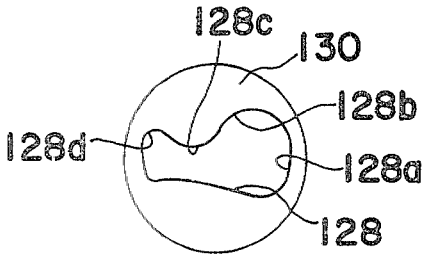
FIG. 3 is a enlarged front view of a disc provided in a sewing pitch control mechanism employed in an embodiment shown in FIG. 2.

An elongated plate 120 is rigidly connected to the end of the shaft 116 remote from the casing 112. One end portion 120*a* of the plate 120 is pivotally connected to a plate 122, so that the plate 122 moves laterally as a result of rotation of the plate 120. The other end portion of the plate 120 is pivotally connected to a plate 124 which has a pin projection 126 at the end thereof remote from the plate 120. This pin projection 126 is engaged to an edge of a detent recess 128 formed in a disc plate 130. The recess 128 as best shown in FIG. 3 has a predetermined pattern defined by portions 128*a*, 128*b*, 128*c* and 128*d*. The disc 130 is eccentrically connected to a shaft 132 which in turn is connected to the dial 20 described above. Since the plate 120 is biased by a spring 134 about the shaft 116 in a clockwise direction when viewed from right, the pin projection 126 is held in contact with an upper edge of the detent recess 128. When the disc 130 is held in a position as shown in FIG. 2, the edge portion 128*b* of the recess 128 is held in contact with the pin projection 126. It is to be noted that the engagement of the pin projection 126 at the portion 128*b* brings the casing 112 in a position with the groove thereof oriented in a vertical direction as shown. At this time, the dial 20 is in position with the arrow 20*a* held in register with the "0" marking. Upon rotation of the disc 130 in a direction A5, the pin projection 126 comes into contact with the portion 128*a* of the recess 128. Therefore, the plate 124 is raised upwardly to allow rotation of the shaft 116 in the direction A3. Thus, the casing 112 is slanted to effect the orbitary movement of the rack member 90 in such a manner as to advance the cloth.

The disc 130 is coupled with an auxiliary disc 130*a* having a smaller diameter than that of the disc 130. This auxiliary disc 130*a* is also eccentrically connected to the shaft 132. Provided under the auxiliary disc 130*a* is an arm 134 having one end portion pivotally connected to the frame of the sewing machine while the other end is held in contact with a platform 136 slidably mounted on a shaft 138 extending in parallel to the shaft 56. An arm 140 extends from the platform 136 with the free end thereof normally terminating adjacent and above a face 122*a* formed in the plate 122. Since the arm 140 is rigidly connected to the shaft 138, the rotation of the arm shaft 140 accordingly results in rotation of the arm 140. Another arm 142 is also rigidly mounted on the shaft 138 at upper portion thereof. This arm 142 is held in contact with a hinged V-shaped block 144 which is in turn held in contact with the uppermost cam 52*a* in the cam arrangement 52. The uppermost cam 52*a* is provided for controlling the cloth movement. The rotation of the cam arrangement 52 results in a jogging motion of the V-shaped block 144 and also the arm 142. Therefore, the shaft 138 is rotated. This rotation of the shaft 138 is transmitted to the arm 140. Normally, since the arm 140 is free from any element, the rotation or jogging movement of the arm 140 is not transmitted to further element. When the dial 20 is turned to a direction A6, however, the recess 128 is rotated to push down the plate 124 as the pin projection 126 slides along the portion 128*c*. Therefore, the plate 122 is forcibly pushed to a direction A7. The further rotation of the dial 20 in the direction A6 pushes down the arm 134 by the auxiliary disc 130*a*, so that the platform 136 is pushed down to lower the arm 140. Thereafter, the pin projection 126 slides into the portion 128*d* to substantially raise the plate 124 for moving the plate 122 towards the direction A8. As a consequence, the face 122*a* of the plate 122 comes into contact with the free end of the arm 140. It is to be noted that this is effected as the dial 20 is brought to a position with the arrow 20*a* registered with the "S" marking. The establishment of such connection between the arm 140 and the face 122*a* transmits the jogging movement of the arm 140 through the plates 122 and 120 to the shaft 116, so that the casing 112 is slanted in the direction A3 or A4 with respect to the jogging of the arm 140. Thus, the movement of the cloth is varied.

An elongated plate 150 is pivotally supported by a pin 152 with upper end thereof held in contact with a cam 154 positioned under the timing cam 60 and rigidly mounted on the shaft 56. The other end of the plate 150 is provided with a pin projection 156 which is slidably accommodated in an elongated groove 122*b* formed in the plate 122. A spring 158 is provided for urging the upper end of the plate 150 to the cam 154. Since the biasing force of the spring 158 is larger than that of the spring 136, the movement of the plate 122 particularly in the direction A8 is restricted by the plate 150. In other words, the pin projection 156 limits the lateral movement of the plate 122 within a distance defined by the effective length of the groove 122*b* between the pin projection 156 and the left end of the groove 122*b*. For example, when carrying out a straight stitch, the upper end of the plate 150 will be held in contact with the most projecting portion of the cam 154 so that the effective length of the groove 122*b* between the pin projection 156 and the left end of the groove 122*b* will be considerably large. Thus, upon rotation of the dial 20 to a large number position, the shaft 116 can be turned to the direction A3 through a large angle. In other words, stitching is effected at an interval of a relatively large pitch while the cloth is advanced. By all means, it is possible to advance the cloth with a small pitch for this straight stitch by simply turning the dial 20 to a smaller number. On the other hand, when carrying out a button hole stitch, it is necessary to stitch the same place repeatedly. In this case, the upper end of the plate 150 will be held in contact with the most detent portion of the cam 154 so that the effective length of the groove 122*b* between the pin projection 156 and the left end of the groove 122*b* will be zero. Therefore, the plate 122 will not be moved to the direction A8 so as to incline the casing 112 in the direction A3, regardless of turning of the dial 20.

The button 22 is position adjacent the upper end of the plate 120 for allowing, when the button 22 is pushed, the shaft 116 to rotate in the direction A4. Thus, the retreat movement of the cloth can be effected during the pushing of the button 22.

Control Device of the Cam Selecting Mechanism

Figure 4:
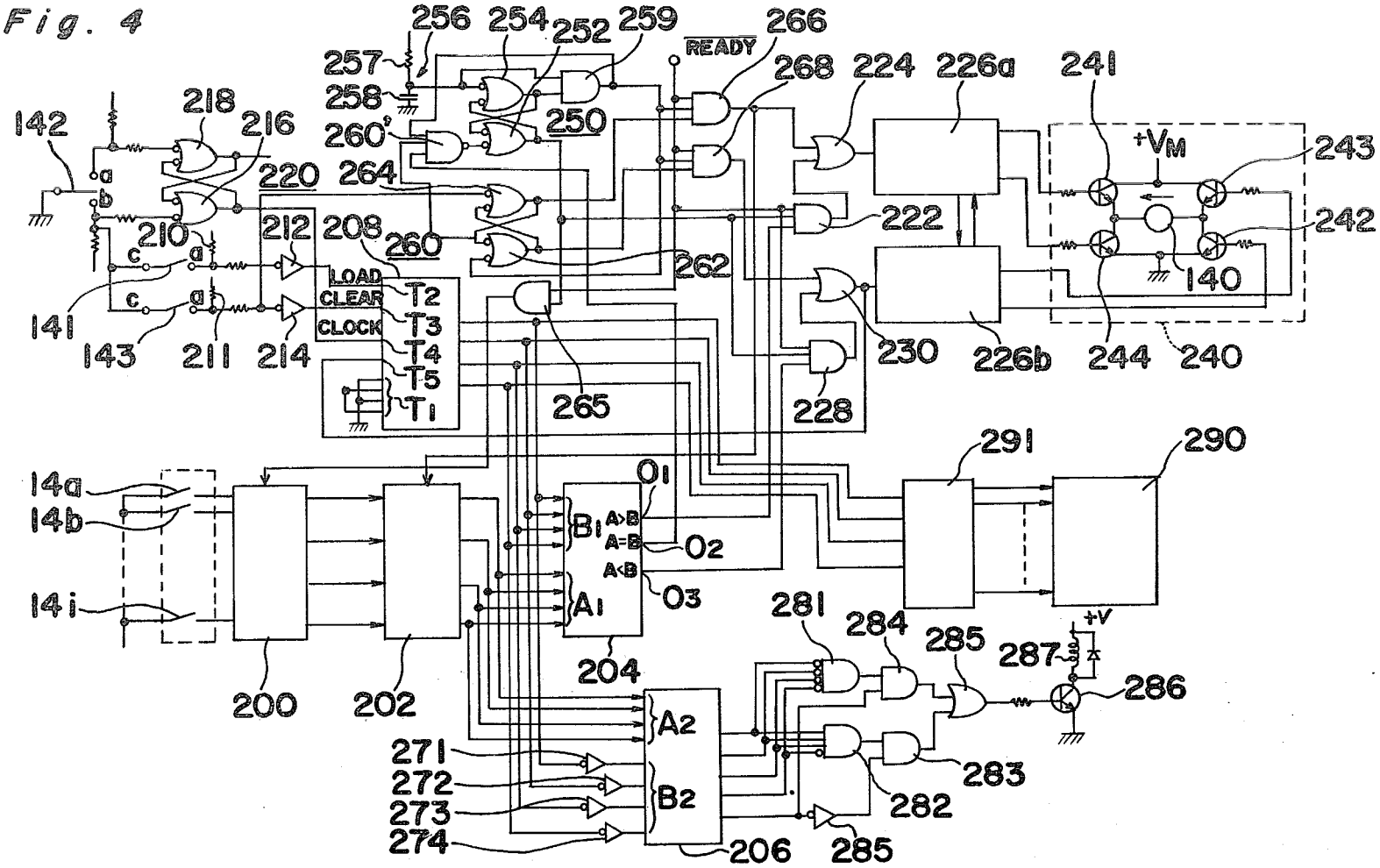
FIG. 4 is an electric circuit diagram of an electric control circuit employed in the embodiment of the sewing machine shown in FIG. 2.

Referring now to FIG. 4, a plurality of push button switches 14*a* through 14*i* for selecting desired pattern cam are connected with an encoder 200 which is adapted to produce coded signals of four bits, representing any one of the push button switches thus selected. The output signals of the encoder 200 have a value peculiar to each of the pattern cams 52-0 through 52-10 of the cam drum 52, for example, the output signals "0000" represent the first pattern cam 52-0 located on the top of the cam drum 52, and "0001" representing the second pattern cam 52-1 placed adjacently below the first pattern cam 52-0.

The outputs of the encoder 200 are applied to a latch 202 and in turn being applied to the input terminals A1 of a comparator 204 and the input terminals A2 of an adder 206. Said comparator 204 is adapted to receive signals of four bits representing the position of the cam follower 72 at the input terminals B1 from an up/down counter 208.

The comparator 204 acts to compare the data A applied to the terminals A1 from the latch 202 and the data B applied to the terminal B1 from the counter 208, thereby to generate a signal at any one of the output terminals 01, 02 or 03 depending on the values of both of the data A and B. As shown in FIG. 4, when the value A is greater than B, i.e., the position of one of th pattern cams selected by the operation of any one of the push button switches 14*a* through 14*i* is higher than the position at which the cam follower 72 exists, the output signal appears at the terminal 01. To the contrary, when the value A is smaller than the value B, the output signal appears at the terminal 03. In case of A=B the output signal appears at the terminal 02.

The output terminals 01, 02 and 03 of the comparator 204 are connected with the input terminals of AND gates 222, 260' and 228 respectively.

The signal appearing on the terminal 01 of the comparator 204 is applied through the AND gate 222 and an OR gate 224 to a motor control circuit 226*a* which operates the motor 62 for movement of the cam follower 72 downward direction. Also, the signal appearing on the terminal 03 is applied through the AND gate 228 and an OR gate 230 to another motor control circuit 226*b* which operates the motor 62 for movement of the cam follower 72 upward direction.

A motor driving circuit 240 comprises a pair of transistors 241 and 242 for driving the motor 62 in one direction corresponding to downward movement of the cam follower 72 and other pair of the transistors 242 and 243 for driving the motor 62 in reversed direction for upward movement of the cam follower 72.

Each base of the transistors 241 and 244 is connected with the motor control circuit 226*a* and each base of the transistors 242 and 243 are connected with the motor control circuit 226 so that the transistors 241 through 244 are selectively conducted upon application of signals to their bases from the motor control circuits 226*a* and 226*b*.

The motor control circuits 226*a* and 226*b* are provided with a known dynamic braking circuit for rapid stopping of the motor 62.

The counter 208 is provided with preset terminals T1 kept with "0101" (10 in decimal system) levels representing the lowermost pattern cam 52-10, a LOAD terminal T2 connected with a normally open contact "a" of the microswitch 169 through an inverter 212. The clear terminal T3 of the counter 208 is connected with a normally open contact "a" of the microswitch 167 through an inverter 214.

Both of the normally open contacts "a" of the microswitches 167 and 169 are held with high level through respective resistors 210 and 211 and the common contacts c thereof are connected with a normally closed contact "b" of the microswitch 168.

The CLOCK terminal T4 of the counter 208 is connected with the set output of an OR gate 216 of a flip flop 220 having an additional OR gate 218. One of the input terminal of the OR gate 216 acting as a reset input terminal of the flip flop 200 is connected with the normally closed contact "b" of the microswitch 168.

The input terminal of the OR gate 218 acting as set input terminal of the flip flop 220 is connected with the normally open contact "a" of the microswitch 168. Said contact "a" of the microswitch 168 is held high level through a resistor 219.

The counter 208 operates as an up counter when the terminal T5 is a low level.

By this circuit arrangement, when the cam follower 72 reaches the uppermost pattern cam 52-0, the microswitch 167 is changed over to "a" contact thereby causing the input of the inverter 214 to be a low level and in turn the output thereof to be a high level and resulting in clearing off the contents of the counter 208.

To the contrary, when the cam follower 72 reaches the lowermost pattern cam 52-10, the microswitch 167 is changed over to "a" contact thereby causing the input terminal of the inverter 212 to be a low level, and in turn the output thereof to be a high level.

Said flip flop 220 produces pulse signals when the microswitch 168 is changed over from the "b" contact to the "a" contact by such action that the arm 66 runs on one of the projections of the timing cam 60 from one of the recess thereof. The pulse signals of the flip flop 220 are applied to the CLOCK terminal of the counter 208 which counts the number of the pulse signals to produce the signals representing the position of the cam follower 72.

A flip flop 250 composed of OR gates 252 and 254 and a flip flop 260 composed of OR gates 262 and 264 are provided for generation of signals indicating the motor control circuits **226*a* and 226*b* to drive the motor 62 in such manner that the cam follower 72 is raised up to the position opposed to the uppermost pattern cam 52-0** after the electric power is switched on.

For this purpose, an interation circuit 256 composed of a resistor 257 and a capacitor 258 is connected with one input terminal of the OR gate 254. The output terminal of the OR gate 254 is connected with the AND gate 259 the output terminal of which is connected with each one input terminal of AND gates 266 and 268 having input terminals receiving a reversed READY signal. The reversed READY signal are adapted to be high level when the stitching operation is not performed. The READY signal may be obtained by means of detecting circuit (not shown) for detecting the rotation of the main motor 26.

The third input terminal of the AND gate 266 is connected with the output terminal of the OR gate 264 to receive a set output of the flip flop 260.

The third input terminal of the AND gate 268 is connected with the output terminal of the OR gate 262 to receive reset output of the flip flop 260. Thus, when the electric power is switched on, the capacitor 258 starts to be charged through the resistor 257 and becomes high level after the lapse of a given time, so that the flip flop 250 is set. The set output of the OR gate 254 of the flip flop 250 is applied to the AND gate 259 to apply a high level signal to the AND gate 268. Since the flip flop 260 is reset when the microswitch 167 is off, i.e., the cam follower 72 is not in the uppermost position, the AND gate 140 allows to give a signal to the motor control circuit **226*b* so as to raise the cam follower 72 up to the highest cam 52-0**.

The reversed READY signal is also adapted to be applied to the inhibit input terminal of the encoder 200 through the AND gate 265 to prevent the application of the pattern selecting signals fed from one of the push buttons **14*a* to 14*i* to the latch 202** during the stitching operation.

The four-bit outputs of the latch 202 are adapted to be applied to the input terminals A2 of the adder 206. On the other hand, the four-bit outputs of the counter 208 are also applied through inverters 271 through 274 to the input terminals B2 of the adder 206 in which the value B representing a position of a pattern cam to which the cam follower 72 is opposed is subtracted from the value representing a position of a pattern cam selected by the push button switches.

Figure 5:
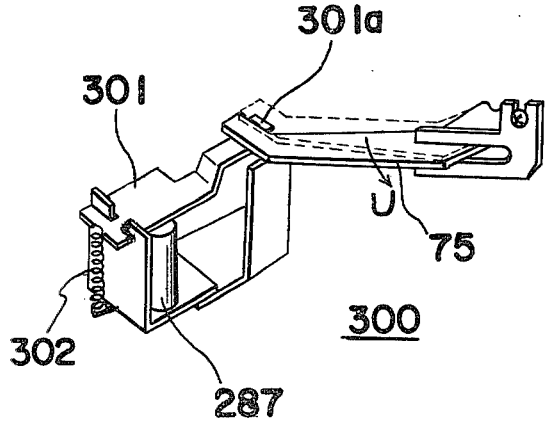
FIG. 5 is a perspective view of an essential portion of a solenoid employed in the embodiment shown in FIG. 2.

The four-bit outputs of the adder 206 is connected with gates 281 and 282. Also, the carry output c of the adder 206 is connected with an AND gate 283 through an inverter 285 and cam AND gate 284 directly. The AND gates 283 and 284 open when the data fed from the latch 202 becomes equivalent to the contents of the counter 208, namely, when the cam follower 72 moves to a selected cam. The output of the AND gate 283 and 284 are connected to an OR gate 285, the output of which is in turn fed to the base of the transistor 286 for exciting the electromagnet 287 of the solenoid 300. In this arrangement, when the transistor 286 is turned on, the electromagnet 287 is excited to keep the cam follower 72 contact the peripheral surface of one of the pattern cam selected and the releasing mechanism as shown in FIG. 5 operates to disengage the arm 66 from timing cam 60 immediately before the cam follower 72 reaches the pattern cam selected.

A display apparatus 290 for displaying the position of the cam follower 72 in digital form is connected with the output terminal of the counter 208 through a decoder 292.

Operation

When an electric power is switched ON, the flip flop 250 is set after the lapse of given time defined by the time constant of the intergration circuit 256 as hereinbefore described, so that the AND gate 259 supplies high level signals to the AND gates 266 and 268 each receiving the reversed READY signal and to the OR gate 134 to reset the flip flop 260. Thus, the flip flop 260 causes the AND gate 268 to open to supply a high level signal to the motor control circuit **226*b* through the OR gate 230. The motor 62 is driven to rotate the shaft 56 and the drum 58. Since an upper annular end of the drum 58 is formed with a generally helical cam face composed of a plurality of steps 58*a* and a corresponding number of slopes 58*b* each positioned between every adjacent two of the steps 58*a*, the arm carrier 70 having its lower end resting on the upper annular end face of the drum 58 elevates along the rod 64 as the drum 58 is rotated counterclockwise (as shown by the arrow X) about the shaft 56 by the motor 62**.

When the cam follower 72 reaches the position corresponding to the uppermost cam 52-0, the microswitch 167 is closed, whereby the flip flop 260 is set in response to the application of the low level signal to the OR gate 264. The set signal is fed to the AND gate 266 which is also applied with the reversed READY signal, so that the AND gate 266 supplies a signal to the motor control circuit **226*a* through the OR gate 224 to rotate the motor 62 and the shaft 56 clockwise, thereby resulting in descending of the cam follower 72**.

Also, the output of the AND gate 266 is fed to the latch 202 to read-in the instruction code (1010) representing the straight stitching pattern cam 52-10. When the cam follower 72 reaches the position opposing to the straight stitching pattern cam 52-10, the flip flop 250 is reset by the signal fed from the microswitch 169 now being changed over to "a" contact.

Thus, the sewing machine is set to perform straight stitching automatically.

Figure 6:
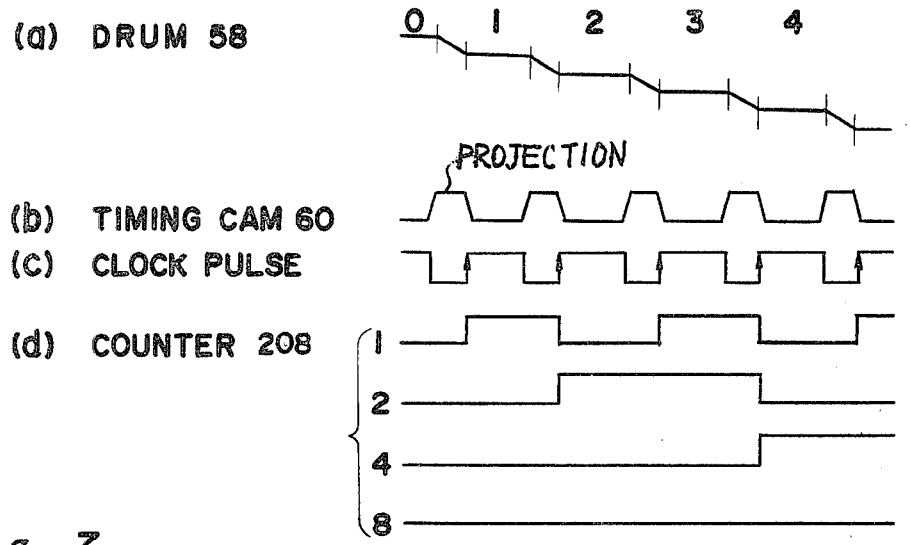
FIG. 6 shows a schematic diagram showing various wave forms appearing on essential portion of the control circuit arrangement shown in FIG. 4 and, FIG. 7 shows various wave forms appearing on essential portion of the circuit arrangement during cam selecting operation.

Operation for selecting one of the desired pattern cams will be explained with reference to FIG. 6 and FIG. 7.

Assuming that the cam follower 72 is located at the position of the fourth pattern cam 52-3, therefore, the counter 208 produces the coded signals "0011". Under such state, when an operator operates the push button switch 14g to select the seventh pattern cam 52-7, the encoder 200 produces coded signals "0110" which is applied to the input terminals A1 of the comparator 204 through the latch 202.

The comparator 204 compares the data "0110" with the data "0011" fed from the counter 208 and produce a high level signal from the output terminal 01. This high level signal is applied to the AND gate 222. As shown in FIG. 7 (g), the AND gate 222 opens to apply the signal for enabling the motor control circuit 226*a* through the OR gate 224.

The motor control circuit 226*a* drives the transistors 241 and 242 so as to rotate the motor 62 and the drum 58 clockwise, thereby the cam follower 72 to descend.

During the movement of the cam follower 72 and the arm carrier 70 along the rod 64 with its lower end sliding in contact with along the slopes 58*b* in the drum, the free end of the arm 66 slides over a corresponding one of the projection of the timing cam 60 and the arm 66 is oscillated about the shaft 64. When the arm 66 reaches one of the projection of the timing cam 60, the microswitch 168 is changed over to conduct the "a" contact, therefore, the flip flop 220 produces a pulse which is fed to the CLOCK input terminal of the counter 208 so as to increase the contents of the counter 208.

Through the operation as described above, when the cam follower 72 descendes one stage of the pattern cam and reaches the fifth pattern cam 52-4, the contents of the counter 208 become "0100". The similar operation as described above is repeated until the cam follower 72 reaches the seventh pattern cam 52-6, while the contents of the counter 208 are applied to the adder 206 through the inventers 271 through 274 to subtract the contents from the data fed from the latch 202.

Figure 7:
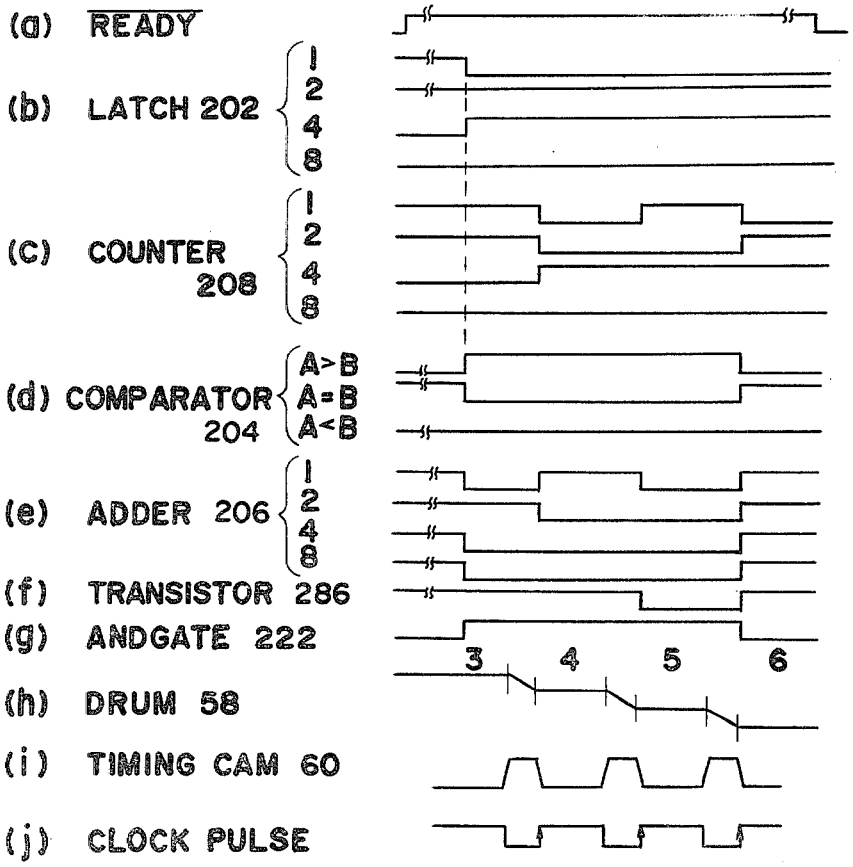

When the cam follower 72 reaches the sixth pattern cam 52-5, and the contents of the counter 208 becomes "0101", the output of the adder 206 becomes "0000" as shown in FIG. 7 (*e*). Accordingly, the gates 281 and 284 open and produce a high level signal to be fed to the transistor 286 through the OR gate 285.

When the transistor 286 is turned on in response to the application of the high level signal, the electromagnet 287 is energized, thereby causing the lock lever 75 to be released from the locked conditions with the result that the cam follower 72 becomes independent of the action of the releasing arm 66. Thus the cam follower 72 becomes to contact the cam 52-5 so that the cam follower 72 and the rod are allowed to oscillate corresponding to the shape of the cam 52-5.

After this operation, when the cam follower reaches the seventh pattern cam 52-6, the contents of the counter 208 becomes "0110", and the outputs of the counter 208 are compared with the output of the latch 202 within the comparator 204, which produce a signal at the terminal 02.

Since the output terminal 01 of the comparator 204 becomes "0", the AND gate 222 is closed, so that the transistors 241 and 242 are turned off to stop the motor 62, thereby causing the cam follower 72 to be stopped at the seventh pattern cam 52-6.

On the other hand, when the outputs of the counter 208 becomes "0110", the outputs of the adder become "1111", so that the gate 251 is closed and in turn the transistor 286 is turned off.

Accordingly, the solenoid 287 releases the armature 301 from the core of the electro magnet by the action of the spring 302 so as to engage the top end 301*a* of the L-shaped portion with the lower surface of the lock lever 75.

The outputs "0110" of the counter 208 is fed to the display device 290 for displaying the position of the selected pattern.

When the foot switch 33 is pressed, the main motor 36 and the main shaft 38 are rotated. The rotation of the main shaft 38 is transmitted to the spur gear 54 for rotation of the pattern cam 52 about the shaft 56.

Since the free end of the cam follower 72 is pressed onto the peripheral surface of the pattern cam 52-6 by the rotational force in the clockwise direction transmitted from the bar member 80 through the link 76, the cam follower 72 is swung in correspondence with the shape of the pattern cam 52-6. This swinging motion of the cam follower 72 is transmitted to the shaft 64, thereby causing the bar member 80, needle bar 42 and the stitching needle 10 to be jogged, so that a required stitching pattern is formed on the cloth.

When an operator operates to select another pattern cam which is placed higher stage than the cam which has been used, the comparator 204 produces a signal at the output 03 since the data A fed from the counter becomes smaller than the data B fed from the LATCH 202.

By the operation, the AND gate 228 opens to apply a signal enabling the motor control circuit 226*b* so as to drive the motor 62 to raise the cam follower 72.

On the other hand, the output of the AND gate 228 is fed to the input terminal T5 of the counter 208 to cause the latter to operate as a down counter. Thus, when the cam follower 72 raises one stage, the contents of the counter 208 is decreased by one in response to a pulse fed from the flip flop 220.

By the operation, the cam follower 72 is transferred to the desired cam.

While the lock lever 75 is rotated in the direction as shown in the arrow U in correspondence with the rotation of the arm 66, the lock lever 75 is engaged with the L-shaped portion 301*a* and the lock lever 75 is locked as shown in the FIG. 5, so that the lock lever 75 and the cam follower 72 are locked in a disengaged position from the periphery of the cam 52. In this case only the arm 66 can be rotated by the timing cam, since the arm 66 is mounted on the rod 64 through one way clutch (not shown).

What is claimed is:

1. An electric sewing machine having a thread carrying needle which is reciprocated in an axial direction thereof and is jogged in a lateral direction and a cloth-advancing mechanism for advancing a cloth in a direction perpendicular to the lateral direction at a predetermined pitch after each stitch is formed for forming a predetermined pattern of stitches, said sewing machine comprising:

a plurality of cam members stacked about a rotational axis, each of said cam members bearing information corresponding to a stitching pattern to be formed on the cloth;

cam follower means movable along the direction parallel to said axis for reproducing the information stored in each of said cam members;

means for transmitting the information reproduced by said cam follower means to said needle to reciprocally move said needle in correspondence with said information;

means for transferring said cam follower means from a position corresponding to one of said cam members to another position corresponding to another one of said cam members, said cam follower transferring means including and being driven by electric motor means;

means for detecting the position of said cam follower means and producing a first data signal representing the position of said cam follower, said means for detecting including:

a timing cam mounted coaxially with said cam member mounting axis for rotation simultaneously with said drum and provided with alternative projections and recesses corresponding to the respective flat surfaces of the drum;

an arm rotatably mounted on the rod member, having its free end slidably contacting with the periphery of the timing cam so as to oscillate about the rod member in correspondence with the projections and recesses;

a microswitch activated by said arm;

a flip flop which is set in response to the signal fed from the microswitch to produce pulse signals every time the cam follower reaches one of the cam members; and a counter for counting the number of the pulse signals fed from the flip flop so that the counter produces said first data signal representative of the position of the cam follower;

manually operable switch means for selecting one of said cam members and for producing a second data signal representative of said selected one of said cam members; and control circuit means for actuating said cam follower transferring means to transfer the cam follower means to a position corresponding to said selected one of said cam members by comparing the first data signal and the second data signal.

2. The electric sewing machine as claimed in claim 1, wherein said cam follower transferring means comprises a cylindrical drum having an helically formed upper end surface consisting of a plurality of generally flat portions with heights corresponding to the respective positions of the cam members and a plurality of slopes disposed between two adjacent flat portions, and said drum being mounted on a shaft coaxial to the axis to which cam members are mounted, said shaft being rotated by said electric motor means; and arm carrier means slidably resting on said upper end surface of the drum and providing a rest for said cam follower means, said arm carrier means being movably mounted parallel to said cam member mounting axis for guiding the movement of said cam follower means resting thereon.

3. The electric sewing machine as claimed in claim 1, wherein each of said cam members is composed of a disc plate having a plurality of projections corresponding to the pattern information around the periphery portion of the disc.

4. The electric sewing machine as claimed in claim 1, wherein said electric control circuit means further comprises circuit means for transferring said cam follower means to a predetermined cam position when the electric power is switched on.

5. The electric sewing machine as claimed in claim 4, wherein the predetermined cam is the cam for straight stitching.

6. The electric sewing machine as claimed in claim 1, further comprising lock means for locking the cam follower means in a position and for releasing engagement of the cam follower means from said cam members during the transferral of the cam follower means.

* * * * *

UNITED STATES PATENT AND TRADEMARK OFFICE

CERTIFICATE OF CORRECTION

PATENT NO. : 4,301,754

DATED : November 24, 1981

INVENTOR(S) : Suzuki et al

It is certified that error appears in the above—identified patent and that said Letters Patent is hereby corrected as shown below:

On the title page,

At the top of the patent, please change the inventor's name from "Suzaki et al" to --Suzuki et al--;

In category [75], change "Kazuo Suzaki" to --Kazuo Suzuki--.

In category [73], it should read:
--Sharp Kabushiki Kaisha, of Osaka, Japan and Aishin Seiki Kabushiki Kaisha, of Aichi, Japan.--.

Signed and Sealed this

Sixteenth Day of November 1982

[SEAL]

Attest:

GERALD J MOSSINGHOFF

Attesting Officer

Commissioner of Patents and Trademarks